US007978869B2

(12) United States Patent
Chang

(10) Patent No.: US 7,978,869 B2
(45) Date of Patent: Jul. 12, 2011

(54) WIRELESS MICROPHONE

(75) Inventor: Kang-Chao Chang, Chiayi (TW)

(73) Assignee: MIPRO Electronics Co., Ltd., Chiayi (TW)

( * ) Notice: Subject to any disclaimer, the term of this patent is extended or adjusted under 35 U.S.C. 154(b) by 1178 days.

(21) Appl. No.: 11/708,946

(22) Filed: Feb. 20, 2007

(65) Prior Publication Data

US 2007/0223764 A1 Sep. 27, 2007

(30) Foreign Application Priority Data

Mar. 13, 2006 (TW) ..... 95204110 U

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/355; 381/360; 381/361

(58) Field of Classification Search ..... 381/355, 381/359, 360, 361, 362, 363, 366, 323; 429/97, 429/98, 100; 455/95

See application file for complete search history.

(56) References Cited

U.S. PATENT DOCUMENTS

| | | | | |
|---|---|---|---|---|
| 5,781,644 | A * | 7/1998 | Chang | 381/370 |
| 6,477,257 | B1 * | 11/2002 | Chang | 381/356 |
| 6,496,588 | B1 * | 12/2002 | Chang | 381/358 |
| 6,778,814 | B2 * | 8/2004 | Koike | 455/95 |
| 6,968,070 | B1 * | 11/2005 | Chiang | 381/361 |

* cited by examiner

*Primary Examiner* — Tuan D Nguyen

(74) *Attorney, Agent, or Firm* — Quine Intellectual Property Law Group, P.C.

(57) ABSTRACT

A wireless microphone includes a perforated front cover mounted on a front open end of a tubular housing, and a control module mounted fixedly on a rear open end of the housing and having an outer surrounding surface provided with a power switch and electrode plates. A rear cover is connected detachably to the control module, and is formed with a switch-receiving groove and through holes. The rear cover is operable so as to be disposed between an adjusted position, where the power switch is exposed from the switch-receiving groove and where the electrode plates are respectively exposed from the through holes, and a used position, where the power switch and the electrode plates are fully covered by the rear cover. A positioning member positions the rear cover at a selected one of the used and adjusted positions.

5 Claims, 6 Drawing Sheets

WIRELESS MICROPHONE

CROSS-REFERENCE TO RELATED APPLICATION

This application claims priority of Taiwanese Application No. 095204110, filed on Mar. 13, 2006.

BACKGROUND OF THE INVENTION

1. Field of the Invention

The invention relates to a microphone, more particularly to a wireless microphone.

2. Description of the Related Art

Referring to FIG. 1, a conventional wireless microphone is shown to include a tubular housing 11, a perforated cover 12 mounted on a front end of the housing 11, a control module 112 mounted fixedly on a rear end of the housing 11, and a rear cover 13 for covering the control module 112. The rear end of the housing 11 is formed with two engaging holes (not shown) opposite to each other. The control module 112 is provided with a power switch 113 at an outer surface thereof. The rear cover 13 has an open end 131, a switch-receiving groove 132 that extends rearwardly from the open end. 131 of the rear cover 13, and opposite engaging hooks 133 that extend frontwardly from the open end 131 of the rear cover 13 and that engage respectively the engaging holes in the rear end of the housing 11 such that the power switch 113 is exposed from the switch-receiving groove 132 in the rear cover 13.

The conventional wireless microphone 1 further includes a rechargeable battery (not shown) disposed in the housing 11. When the rechargeable battery is charged via two charging electrodes (not shown) mounted on the control module 112, the rear cover 13 must be removed. As such, the rear cover 13 may be misplaced.

Furthermore, since the engaging hooks 133 of the rear cover 13 extend from the open end 131 of the rear cover 13, the engaging hooks 133 are easily damaged due to impact when the rear cover 13 is removed from the control module 112.

SUMMARY OF THE INVENTION

Therefore, the object of the present invention is to provide a wireless microphone that can overcome the aforesaid drawbacks of the prior art.

According to the present invention, a wireless microphone comprises:

a tubular housing extending along a longitudinal direction and having front and rear open ends;

a perforated front cover mounted on the front open end of the housing;

a control module mounted fixedly on the rear open end of the housing and having an outer surrounding surface provided with a power switch and a plurality of electrode plates;

a rear cover covering and connected detachably to the control module, the rear cover being formed with a switch-receiving groove and a plurality of through holes, the rear cover being operable so as to be disposed between an adjusted position, where the power switch of the control module is exposed from the switch-receiving groove in the rear cover and where the electrode plates of the control module are respectively exposed from the through holes in the rear cover, and a used position, where the power switch and the electrode plates of the control module are fully covered by the rear cover; and a positioning member for positioning the rear cover at a selected one of the used and adjusted positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
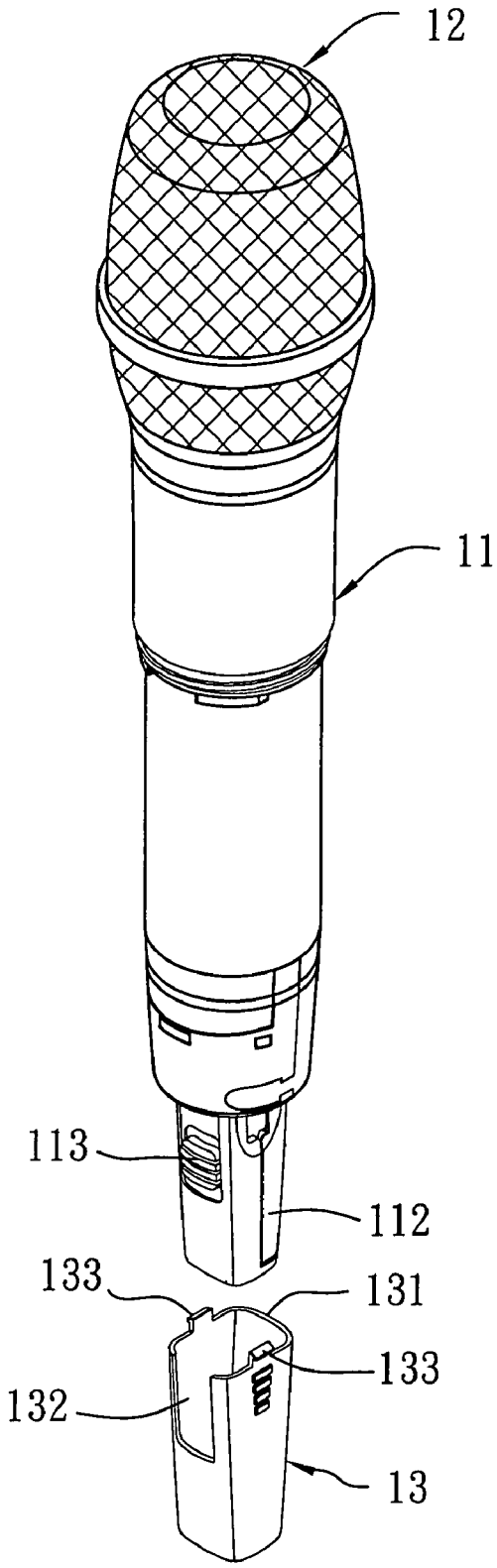
FIG. 1 PRIOR ART
FIG. 1 is a partly exploded, perspective view of a conventional wireless microphone.

Referring to FIGS. 2 to 5, the preferred embodiment of a wireless microphone according to the present invention is shown to include a tubular housing 2, a perforated front cover 3, a control module 5, a rear cover 4, and a positioning member 6.

The tubular housing 2 extends along a longitudinal direction (A), and has front and rear open ends 21, 22.

The front cover 3 is mounted on the front open end 21 of the housing 2.

The control module 5 is mounted fixedly on the rear open end 22 of the housing 2, and has an outer surrounding surface 51 provided with a power switch 54, and a plurality of electrode plates 55 (see FIG. 4) adapted to be connected electrically to an external charger (not shown). In this embodiment, the control module 5 further includes a set of function keys 56 mounted on the outer surrounding surface 51 and disposed adjacent to the power switch 54 for other control purposes.

Figure 2:
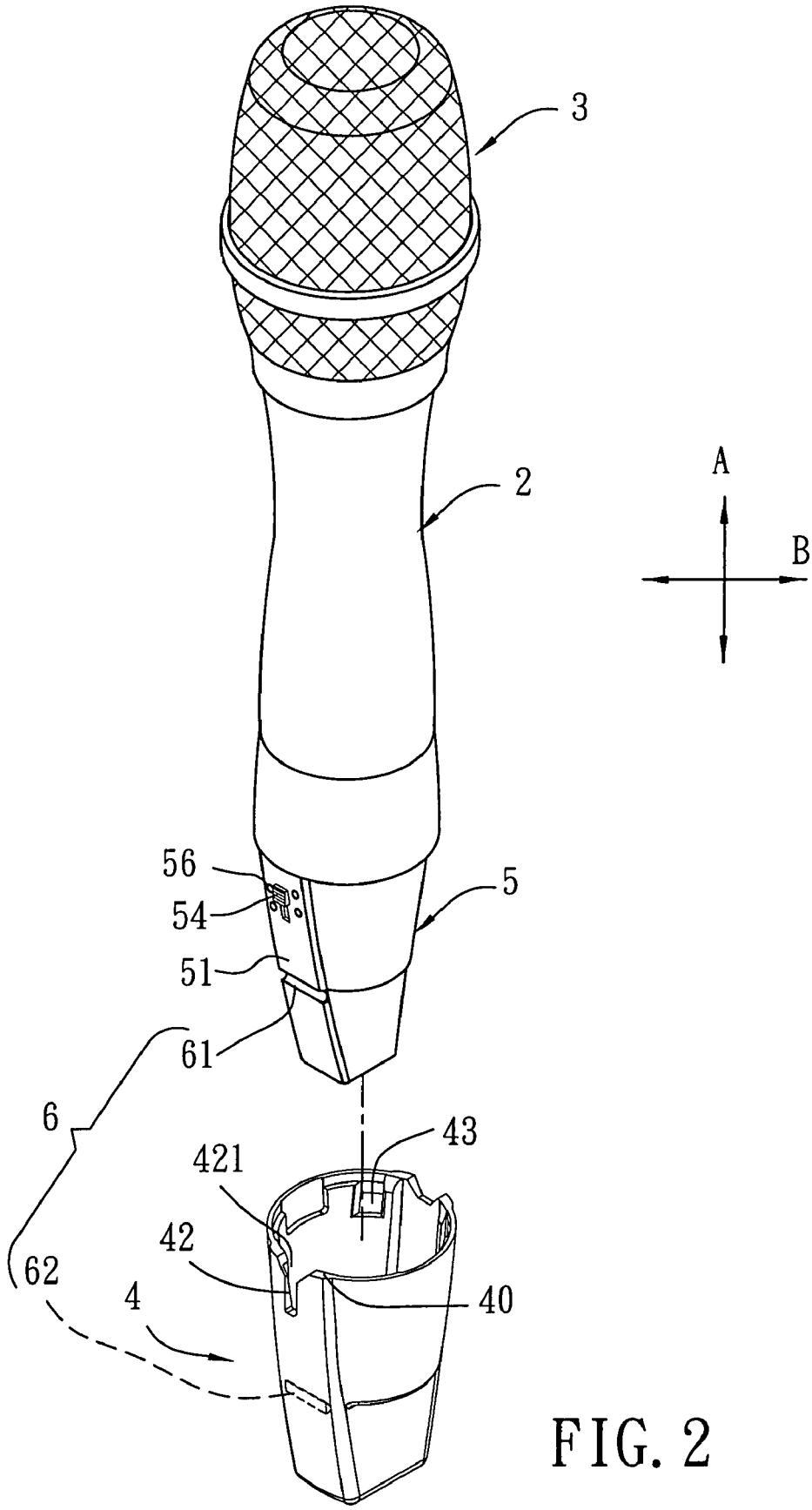
FIG. 2 is a partly exploded, perspective view showing the preferred embodiment of a wireless microphone according to the present invention.
Figure 3:
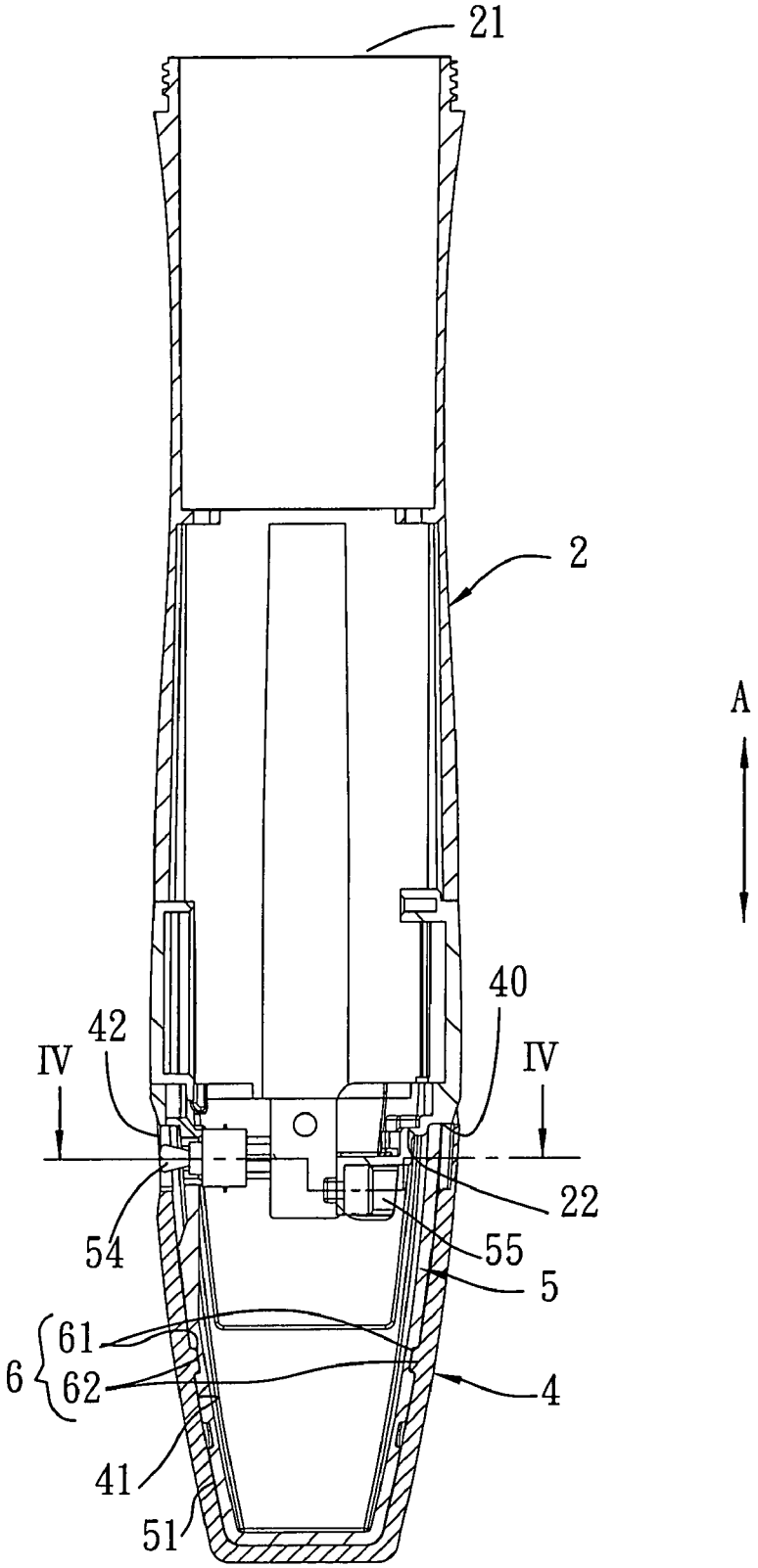
FIG. 3 is a schematic sectional view showing the preferred embodiment when a rear cover is at an adjusted position.
Figure 4:
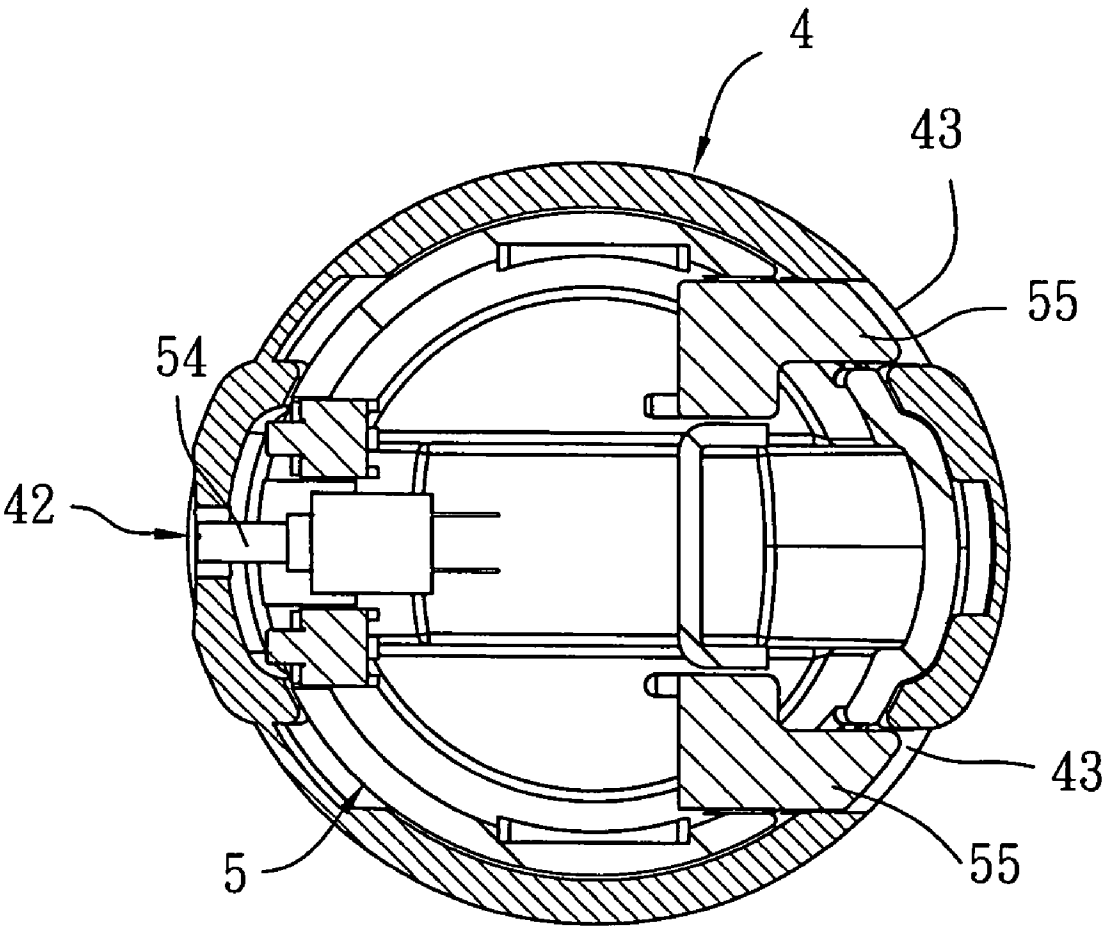
FIG. 4 is a schematic sectional view showing the preferred embodiment taken along line IV-IV in FIG. 3.
Figure 5:
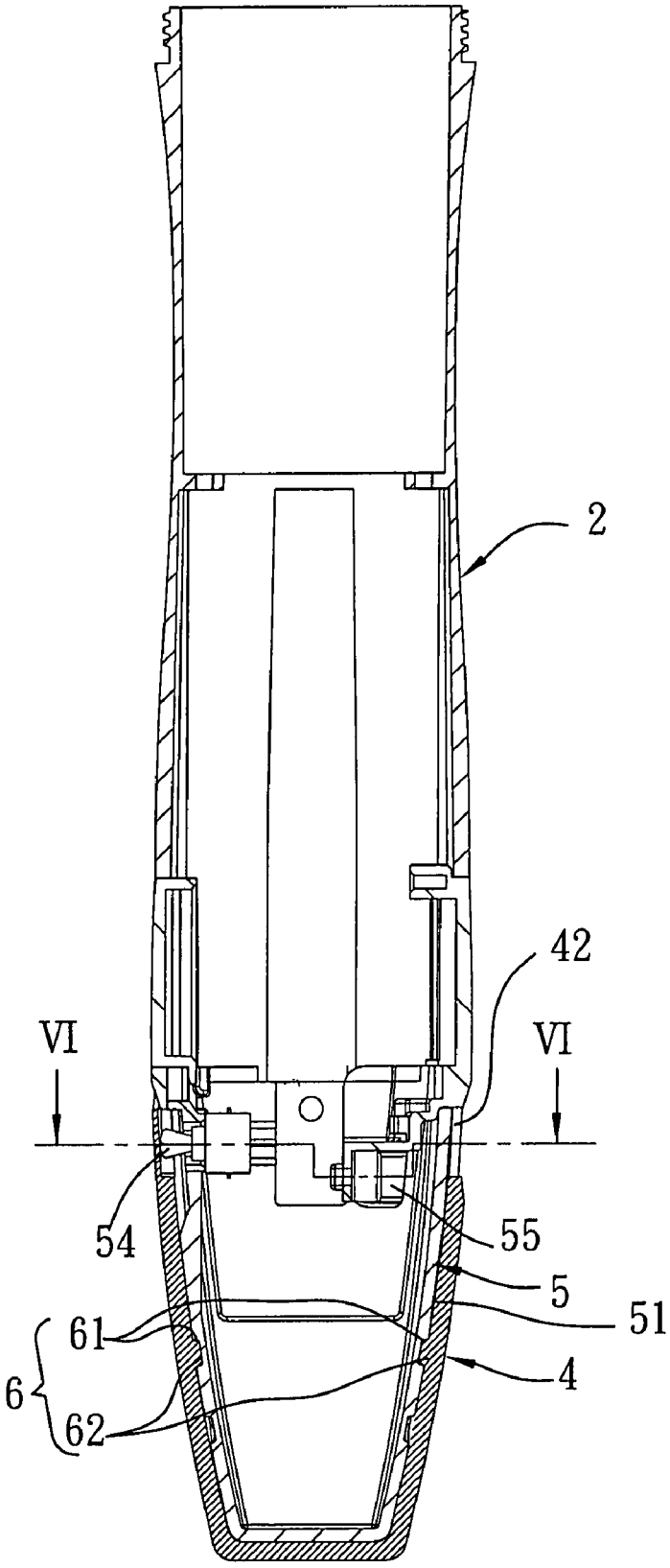
FIG. 5 is a schematic sectional view showing the preferred embodiment when the rear cover is at a used position.
Figure 6:
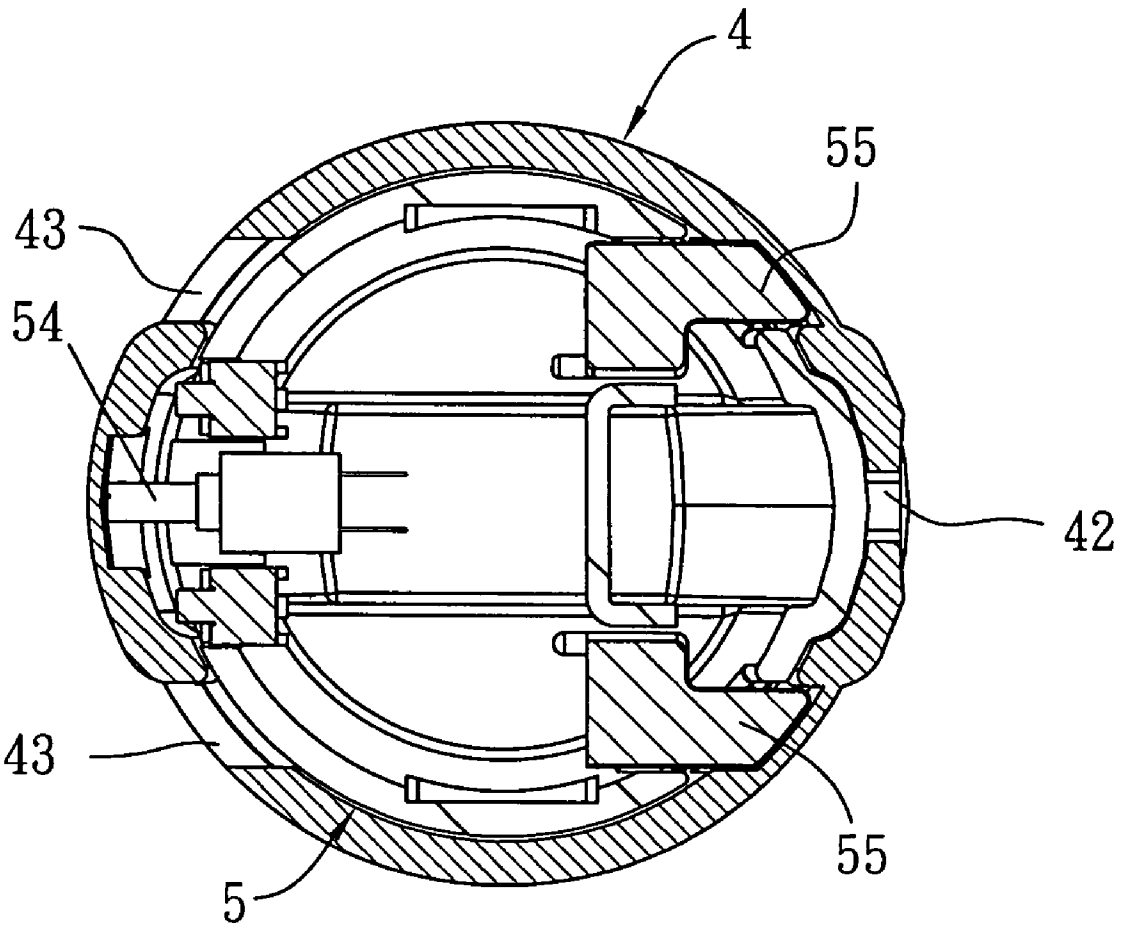
FIG. 6 is a schematic sectional view showing the preferred embodiment taken along line VI-VI in FIG. 5.

The rear cover 4 is connected detachably to the control module 5. The rear cover 4 has an edge 40 abutting against the rear open end 22 of the housing 2, is formed with a switch-receiving groove 42, and a plurality of through holes 43. In this embodiment, the switch-receiving groove 42 extends along the longitudinal direction (A), and has an open end 421 formed at the edge 40 of the rear cover 4, as shown in FIG. 2. The rear cover 4 is operable so as to be disposed between an adjusted position, where the power switch 54 of the control module 5 is exposed from the switch-receiving groove 42 in the rear cover 4 and where the electrode plates 55 of the control module 5 are respectively exposed from the through holes 43 in the rear cover 4, as best shown in FIG. 4, and a used position, where the power switch 54 and the electrode plates 55 of the control module 5 are fully covered by the rear cover 4, as best shown in FIG. 6. It is noted that, in this embodiment, whether the rear cover 4 is at the adjusted position or the used position, the function keys 56 of the control module 5 are always covered by the rear cover 4. As such, the function keys 56 cannot be operated unless the rear cover 5 is removed.

The positioning member 6 positions the rear cover 4 at a selected one of the used and adjusted positions. In this embodiment, the positioning member 6 includes opposite engaging grooves 61 formed in the outer surrounding surface 51 of the control module 5 and extending along a transverse direction (B) perpendicular to the longitudinal direction (A), and opposite engaging blocks 62 formed on the inner surface 41 of the rear cover 4 and engaging respectively the engaging grooves 61.

In such a configuration, when the rear cover 4 is at the adjusted position, the wireless microphone of this invention is suitable for power control and charging operation. As a result, the rear cover 4 is not required to be separated from the control module 5 when at the adjusted position, thereby preventing misplacement of the rear cover 4. On the other hand, when the rear cover 4 is at the used position, the power switch 54 and the function keys 56 are covered by the rear cover 4, thereby avoiding unintentional operation for the power switch 54 and the function keys 56 as frequently encountered in the aforesaid conventional wireless microphone.

Furthermore, the engaging blocks 62 of the positioning member 6 are formed on the inner surface 41 of the rear cover 4, thereby avoiding damage to the engaging blocks 62 due to impact. When the engaging blocks 62 engage respectively the engaging grooves 61, i.e., the rear cover 4 is exactly positioned on the control module 5 by the positioning member 6, the rear open end 22 of the housing 2 abuts against the edge 40 of the rear cover 4. Therefore, it is easily confirmed whether the engaging blocks 62 engage respectively the engaging grooves 61 by visually inspecting whether the rear open end 22 of the housing 2 abuts against the edge 40 of the rear cover 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wireless microphone comprising:

a tubular housing extending along a longitudinal direction and having front and rear open ends;

a perforated front cover mounted on said front open end of said housing;

a control module mounted fixedly on said rear open end of said housing and having an outer surrounding surface provided with a power switch and a plurality of electrode plates;

a rear cover covering and connected detachably to said control module, said rear cover being formed with a switch-receiving groove and a plurality of through holes, said rear cover being operable so as to be disposed between an adjusted position, where said power switch of said control module is exposed from said switch-receiving groove in said rear cover and where said electrode plates of said control module are respectively exposed from said through holes in said rear cover, and a used position, where said power switch and said electrode plates of said control module are fully covered by said rear cover; and a positioning member for positioning said rear cover at a selected one of the used and adjusted positions.

2. The wireless microphone as claimed in claim 1, wherein said positioning member includes an engaging groove formed in one of said outer surrounding surface of said control module and an inner surface of said rear cover, and an engaging block formed on the other one of said outer surrounding surface of said control module and said inner surface of said rear cover and engaging said engaging groove.

3. The wireless microphone as claimed in claim 2, wherein said engaging groove of said positioning member is formed in said outer surrounding surface of said control module, and extends along a transverse direction perpendicular to the longitudinal direction.

4. The wireless microphone as claimed in claim 1, wherein said control module further includes a set of function keys mounted on said outer surrounding surface, disposed adjacent to said power switch, and covered by said rear cover when said rear cover is in the used position.

5. The wireless microphone as claimed in claim 1, wherein said switch-receiving groove in said rear cover extends along the longitudinal direction, and has an open end formed at an edge of said rear cover.

* * * * *